United States Patent [19]

Budzich et al.

[11] 4,248,353

[45] Feb. 3, 1981

[54] APPARATUS FOR COLLECTING DRIPPINGS FROM A WET LOAD CARRIED BY A CRANE

[75] Inventors: Mieczyslaw Budzich; Forest G. Fitz, Jr., both of Lexington, S.C.

[73] Assignee: Nassau Recycle Corporation, Staten Island, N.Y.

[21] Appl. No.: 21,274

[22] Filed: Mar. 16, 1979

[51] Int. Cl.[3] ..... B08B 3/04; B66C 13/00

[52] U.S. Cl. ..... 212/128; 118/425; 118/501; 134/135; 134/183; 204/198; 204/225

[58] Field of Search ..... 212/11; 134/76, 77, 134/135, 154, 182, 183; 118/425, 501; 204/198, 225, 300 EC

[56] References Cited

U.S. PATENT DOCUMENTS

| | | | |
|---|---|---|---|
| 2,574,149 | 11/1951 | Kahn | 134/183 X |
| 2,646,769 | 7/1953 | Lindsay | 118/11 |
| 3,028,267 | 4/1962 | Edhofer | 134/183 X |
| 3,039,432 | 6/1962 | Le Boutillier | 134/117 X |
| 3,699,983 | 10/1972 | Morley | 134/76 |

*Primary Examiner*—Stephen G. Kunin
*Assistant Examiner*—Terrance L. Siemens
*Attorney, Agent, or Firm*—Robert B. Kennedy

[57] ABSTRACT

Apparatus is provided for collecting drippings from a wet load carried by a crane having a carriage 14, 16 to which elements 10, 12, 18, 20, 22 for lifting loads are mounted for movement up to and down from a load carrying station beneath the carriage. The apparatus comprises supports 30 mounted dependent from the crane carriage along opposite sides of the load carrying station. A cradle 61 is pivotably suspended from the crane for pivotal movement about an axis passing through the load carrying station. Elements 34, 36, 38, 42, 44, 46, 52, 60 are included for pivoting the cradle between a lowered position beneath the load carrying station and a raised position beside the load carrying station.

3 Claims, 4 Drawing Figures

APPARATUS FOR COLLECTING DRIPPINGS FROM A WET LOAD CARRIED BY A CRANE

TECHNICAL FIELD

This invention relates generally to cranes, and particularly to cranes used in handling articles being wet processed.

BACKGROUND OF THE INVENTION

In the processing of many articles they must be successively placed in one or more liquid baths for treatment. For example, in electroplating and electrorefining installations various structures such as anodes and cathodes are placed in open top tanks housing acidic electrolytes. Periodically the articles are emerged from the tanks and relocated into other tanks containing liquids of other compositions or of differing concentrations, and finally into dry storage. To relocate the articles lifting devices such as travelling beams and cranes are employed which move back and forth over the tanks. The lifting devices are periodically positioned over the tanks and lowered into gripping engagement with a submerged article which is then lifted from the tank. The lifting device is then laterally repositioned over another tank, a rinse station or dry storage station and the article lowered.

While the loaded articles are raised out of the tanks for repositioning they are, of course, in a wet condition. Liquids on their surfaces will thus gravitate down the article sides and then fall as drippings. While the articles are still located above the tanks from which they have emerged such drippings do not ordinarily present a problem. However, once the lifting device has moved the article laterally away from the tank such drippings may fall into other tanks housing other liquids and contaminating them. In other cases the wet articles or loads may be moved over dry areas and fall directly upon personnel creating a safety problem or upon the floor damaging it or rendering it slippery and hazardous.

To alleviate the just described problem drip trays have heretofore been associated with lifting devices employed in wet processing installations for movement into and out from positions beneath the lifting devices. For example, in U.S. Pat. No. 3,699,983 tracks are mounted over a row of wet processing tanks upon which a trolley is driven. A lifting mechanism is supported on the trolley for raising and lowering work pieces into various tanks. A drip tray is also mounted to the trolley for lateral movement between a position beneath the lifting device and to one side the lifting device.

Though apparatuses of the type just described have served to prevent drippings from wet loads on lifting device from polluting other tanks or dripping onto adjacent floor areas and personnel, the apparatuses themselves have been bulky and cumbersome. In addition, such cannot be utilized in many wet processing installations or tank houses where tanks extend virtually from one wall of the tank house to the other since in such cases there is no room to accomodate the drip pan in its withdrawn position beside the lift. Having to have its own track and drive, these apparatuses are quite bulky, costly and in need of frequent maintenance. Proper counterbalancing has also been difficult to achieve. The present invention thus seeks to provide other apparatus for collecting drippings from a wet load carried by a crane in which the just described deficiencies are alleviated.

SUMMARY OF THE INVENTION

In one form of the invention an apparatus is provided for collecting drippings from a wet load carried by crane having a carriage to which means for lifting loads are mounted for movement up to and down from a load carrying station beneath the carriage. The apparatus comprises support means adapted to be mounted dependent from the crane carriage along opposite sides of the load carrying station, a cradle pivotably suspended from the support means for pivotable movement about an axis located adjacent the load carrying station, and means for pivoting the cradle between a lower position beneath the load carrying station and a raised position aside the load carrying station.

DETAILED DESCRIPTION

Figure 1:
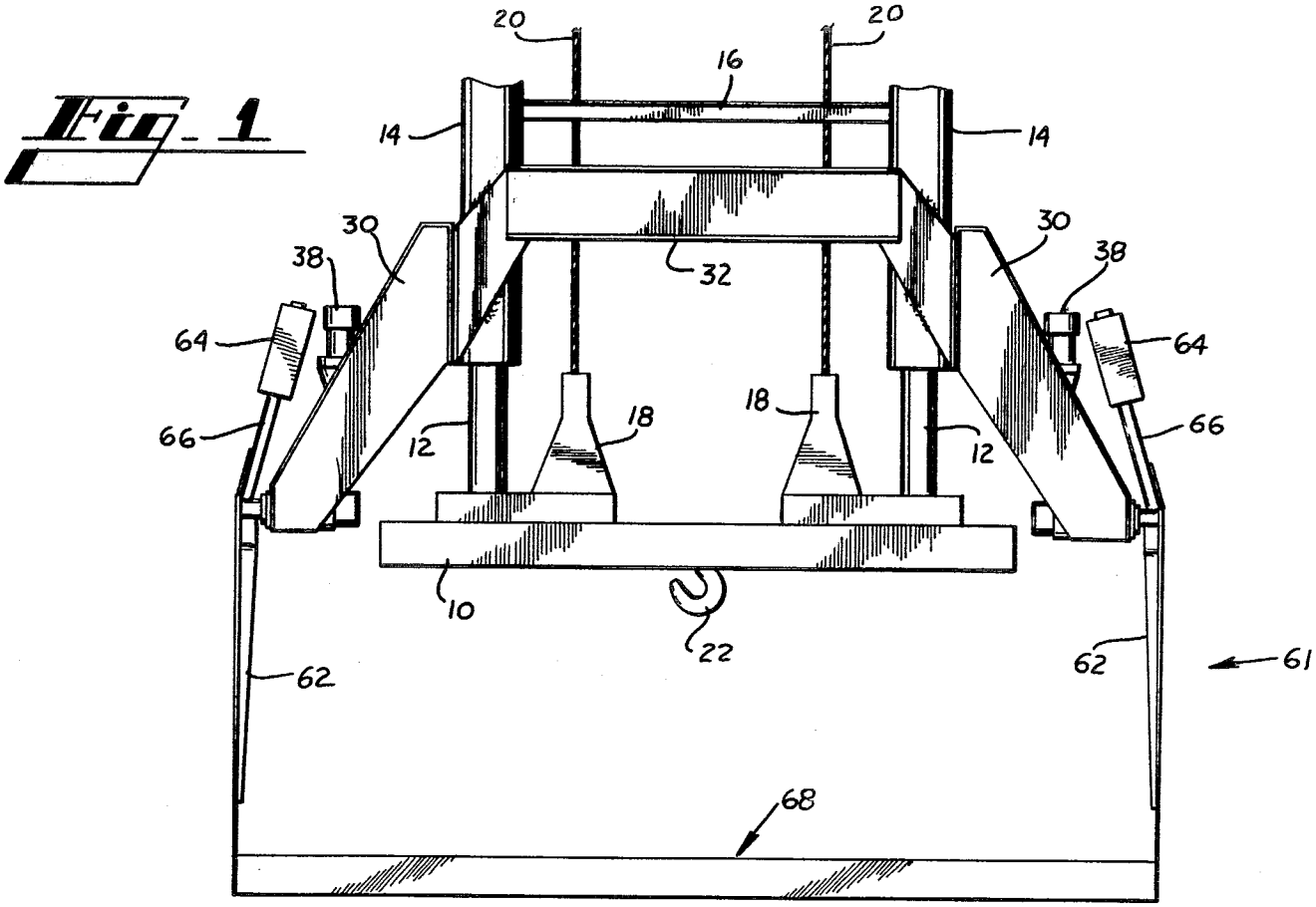
FIG. 1 is a front elevational view of apparatus embodying principles of the present invention shown mounted to a lower portion of a crane.
Figure 2:
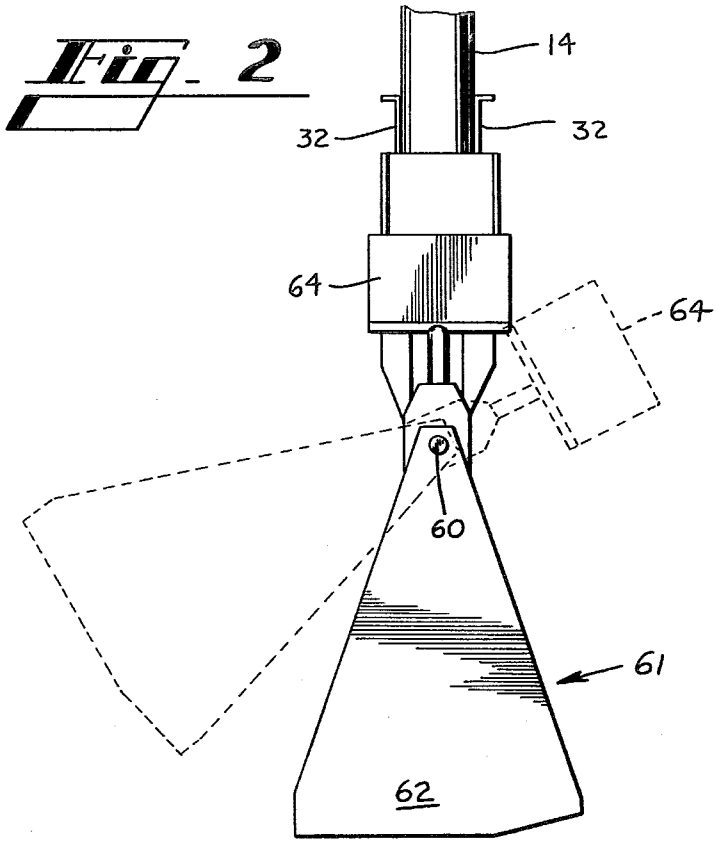
FIG. 2 is a side elevational view of the apparatus shown in FIG. 1.
Figure 3:
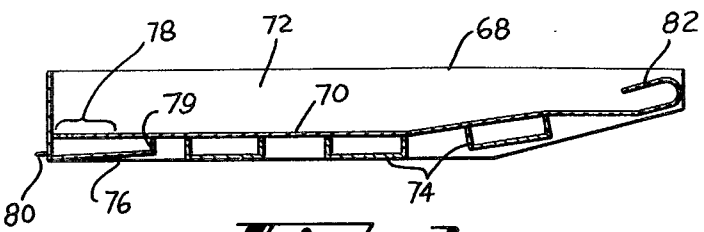
FIG. 3 is a cross-sectional view of a lower portion of the apparatus shown mounted to a crane in FIGS. 1 and 2.

Referring now in more detail to drawing, there is shown a lower portion of a conventional crane forming part of what may be considered as the crane carriage and load lifting device. The crane lifting device includes a bale 10 from which a pair of guide tubes 12 upwardly extend that are telescopically received within another pair of tubes 14 spanned by a pair of beams 16 which form part of the carriage. A pair of unshown bale lifting sheaves is rotatably mounted within sheave housings 18 atop the bale over which lifting cables 20 are routed. For simplicity a single hook 22 is shown dependent from the crane bale. It should however be understood that standard lifting racks may alternatively be attached dependent from the bale in lieu, or in additional to, the hook. In FIG. 1 the bale is shown at a raised, load carrying station.

Figure 4:
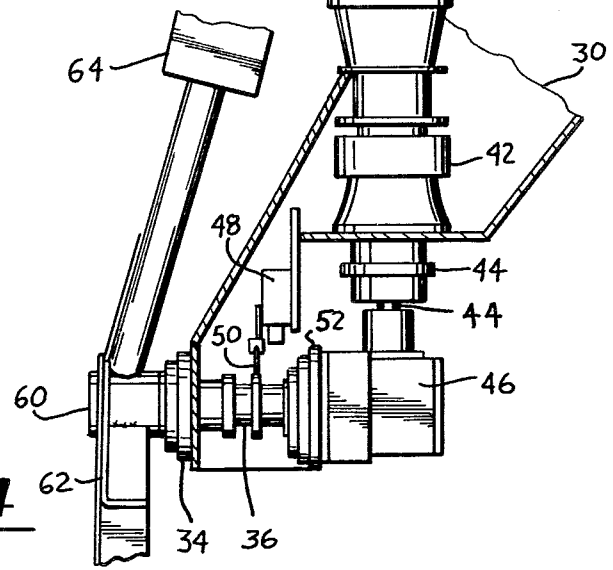
FIG. 4 is a side elevational view, in more detail, of one of the two means for pivoting the apparatus shown mounted to the crane in FIGS. 1–3.

With continued reference to the drawing apparatus is shown attached to the crane for collecting drippings from a wet load carried by the hook 22 or a lifting rack. The apparatus comprises a pair of support structures 30 mounted to the crane carriage tubes 14, and a pair of beams 32 which straddle the crane bale lifting cables 20. As best shown in FIG. 4, which illustrates the details of one of two power trains, bearings 34 and 52 are mounted to the bottom of each of the support structures 30 through which a shaft 36 is journalled. An electric motor and brake assembly 38 is mounted to a vertical gear box 42 which is mounted to structure 30. The output gear box 42 drives a right angle gear box 46 through a torque limiting slip clutch 44. The shaft 36 is driven by gear box 46 with travel limited by two limit switches 48 having a switch actuator 50 positioned on shaft 36.

To each of the enlarged end caps 60, rigidly secured to the ends of shafts 36, is pivotably mounted a cradle 61. The cradle is comprised of a pair of swing arms 62 rigidly secured to one side of the end caps while a